US006502334B1

(12) United States Patent
Davies

(10) Patent No.: US 6,502,334 B1
(45) Date of Patent: Jan. 7, 2003

(54) ATTACHMENT FOR AN ALL TERRAIN VEHICLE

(76) Inventor: Stephen Davies, Box 2745, Pincher Creek, Alberta (CA), T0K 1W0

( * ) Notice: Subject to any disclaimer, the term of this patent is extended or adjusted under 35 U.S.C. 154(b) by 0 days.

(21) Appl. No.: 09/431,262

(22) Filed: Nov. 1, 1999

(30) Foreign Application Priority Data

Oct. 29, 1999 (CA) ..... 2287747

(51) Int. Cl.[7] ..... E01H 5/06

(52) U.S. Cl. ..... 37/231; 37/231; 37/266; 172/811

(58) Field of Search ..... 37/231–234, 241, 37/243, 266–271, 280, 281; 172/811

(56) References Cited

U.S. PATENT DOCUMENTS

| | | | | | |
|---|---|---|---|---|---|
| 3,688,847 | A | | 9/1972 | Deeter | |
| 4,096,652 | A | * | 6/1978 | Raines et al. | 37/281 |
| 4,615,130 | A | | 10/1986 | Racicot | |
| 4,687,447 | A | | 8/1987 | Hannappel | |
| 4,754,832 | A | | 7/1988 | Allen et al. | |
| 4,890,400 | A | * | 1/1990 | Long | 37/117.5 |
| 4,910,893 | A | * | 3/1990 | Asay | 37/281 |
| 5,195,261 | A | * | 3/1993 | Vachon | 37/231 |
| 5,205,058 | A | * | 4/1993 | Allen et al. | 37/231 |
| 5,329,708 | A | * | 7/1994 | Segorski et al. | 37/231 |
| 5,381,647 | A | * | 1/1995 | Eberle | 56/15.8 |
| 5,967,241 | A | * | 10/1999 | Cross et al. | 172/811 |
| 6,102,131 | A | * | 8/2000 | Malinowski | 172/273 |

FOREIGN PATENT DOCUMENTS

| | | |
|---|---|---|
| CA | 1233983 | 3/1988 |
| CA | 2121948 | 10/1994 |

* cited by examiner

*Primary Examiner*—Robert E. Pezzuto
*Assistant Examiner*—Kristine Markovich
(74) *Attorney, Agent, or Firm*—Susan D. Beanbien; Borden Ladner Gervais LLP

(57) ABSTRACT

An attachment for an all terrain vehicle (ATV) which enables the ATV to be used for clearing away snow and other loose granular material, such as sand, earth, and crushed stones. The apparatus includes a blade with a detachable liner, and a frame which fits beneath the ATV and is releasably connected to the outer sides of the ATV by a mounting device. The angle of the blade may be adjusted using a dual-handed lever. The blade may be raised and lowered by the driver while seated at the ATV using a handle which actuates a lever and a cable and pulley apparatus.

3 Claims, 8 Drawing Sheets

ATTACHMENT FOR AN ALL TERRAIN VEHICLE

FIELD OF THE INVENTION

The present invention relates to a device which can be attached to an all terrain vehicle ("ATV") and used for clearing away loose granular material, such as snow, sand, earth, and crushed stones.

BACKGROUND OF THE INVENTION

All terrain vehicles are popularly used by consumers as recreational vehicles. However, given their ability to manoeuvre on a variety of terrains, ATVs have the potential to be adapted for practical applications such as the removal of snow. Accordingly, there is consumer demand for an ATV attachment which enables the ATV to be used for clearing snow and other loose granular material, such as sand, earth and crushed stones.

It is desirable that the attachment be easily installed and removed, so that the vehicle does not carry any unnecessary weight when the attachment is not in use. However, the devices found in the prior art are relatively cumbersome to install and remove, or have limited applications. Typically, the attachment points for these devices are situated on the underside of the ATV, so that they are not readily accessible to the user. U.S. Pat. No. 3,688,847 teaches a frame assembly which requires the removal of the front wheels of the vehicle in order to initially install the attachment piece for hooking up the frame assembly. U.S. Pat. No. 4,615,130 teaches a frame assembly suitable only for ATV's having a trailer—type hitch on the rear—end of the vehicle. Accordingly, there is a need for an assembly which can be quickly and easily attached and detached from ATV's.

In certain situations it may be desirable to change the angle of the blade on the attachment, for example, when clearing snow adjacent to a wall or fence. However, the prior art suffers from the disadvantage that it can be relatively cumbersome to adjust the angle of the blade. For example, U.S. Pat. No. 4,615,130 teaches the use of retractable pins as a means for locking the blade at a desired angle. However, the removal and insertion of pins requires a certain degree of manual dexterity and maybe difficult to accomplish under cold-weather conditions, when the driver of the ATV is likely to be wearing gloves. Accordingly, there is a need for a device equipped with means for quickly and conveniently adjusting the angle of the blade.

In certain situations, it may also be desirable to raise the blade, for example when travelling to a destination which needs to be cleared. Accordingly, it is desirable to have an attachment that can be easily raised and lowered by the driver while seated on the MV.

Finally, the prior an does not teach a blade with a detachable liner, which would allow the liner to be inexpensively replaced if it becomes damaged, and which would also allow the liner to be inexpensively colour coordinated with the customer's ATV.

SUMMARY OF THE INVENTION

The disadvantages of the prior at are obviated and mitigated by the present invention which provides an attachment for use in shoveling snow and other loose granular material, which can be quickly and easily attached and detached from an ATV; which enables the operator of the MV to easily and quickly adjust the blade to a desired angle; and easily raise or lower the blade of the ATV while seated on the ATV.

In a preferred embodiment, the snow blade has a coloured liner detachably secured to the blade frame, which may be colour coordinated with the body of the ATV.

In a preferred embodiment, the invention provides an apparatus which may be attached to an all terrain vehicle for use in clearing loose granular material; said apparatus comprising a frame assembly adapted to fit beneath the all terrain vehicle in a spaced apart relationship thereto, and to be releasably connected to the outer sides of the all terrain vehicle by a mounting means; blade means for use in clearing loose granular material; said blade means attached to the frame assembly at the front-end of the all terrain vehicle; angle adjustment means for adjusting the angle of the blade means relative to the longitudinal axis of the all terrain vehicle; and vertical adjustment means for raising and lowering said blade means and said frame assembly.

A further embodiment provides a kit comprising a frame assembly adapted to fit beneath the all terrain vehicle in a spaced apart relationship thereto, and to be releasably connected to the outer sides of the all, terrain vehicle by a mounting means; blade means for use in clearing loose granular material; said blade means attached to the frame assembly at the front-end of the all terrain vehicle; angle adjustment means for adjusting the angle of the blade means relative to the longitudinal axis of the all terrain vehicle; and vertical adjustment means for raising and lowering said blade means and said frame assembly.

Additionally, the invention provides an attachment means for releasably securing a frame assembly and blade means to an all terrain vehicles comprising angle adjustment means for adjusting the angle of the blade means relative to the longitudinal axis of the all terrain vehicle; and vertical adjustment means for raising and lowering said blade means and said frame assembly.

An advantage of the present invention is that the attachment points for the frame assembly are easily accessible on the outer sides of the ATV, and therefore the frame assembly can be attached and detached quickly and easily.

Preferably, the vertical adjustment means comprises a dual-handed lever which enables the operator to easily adjust the angle of the blade from either side of the ATV. Because the angle of the blade is adjusted using a simple lifting and turning motion, it is possible to adjust the angle of the blade even while wearing gloves.

A further advantage of this invention is that the driver can easily raise or lower the blade and frame assembly while seated on the ATV, through the use of an over-centering mechanism which enables the blade to stay locked in the up position without the use of latch pins or extra brackets.

BRIEF DESCRIPTION OF THE DRAWINGS

A better understanding of the invention will be obtained by considering the detailed description below, with reference to the following drawings of embodiments of the present invention in which.

DETAILED DESCRIPTION OF THE INVENTION

Figure 1:
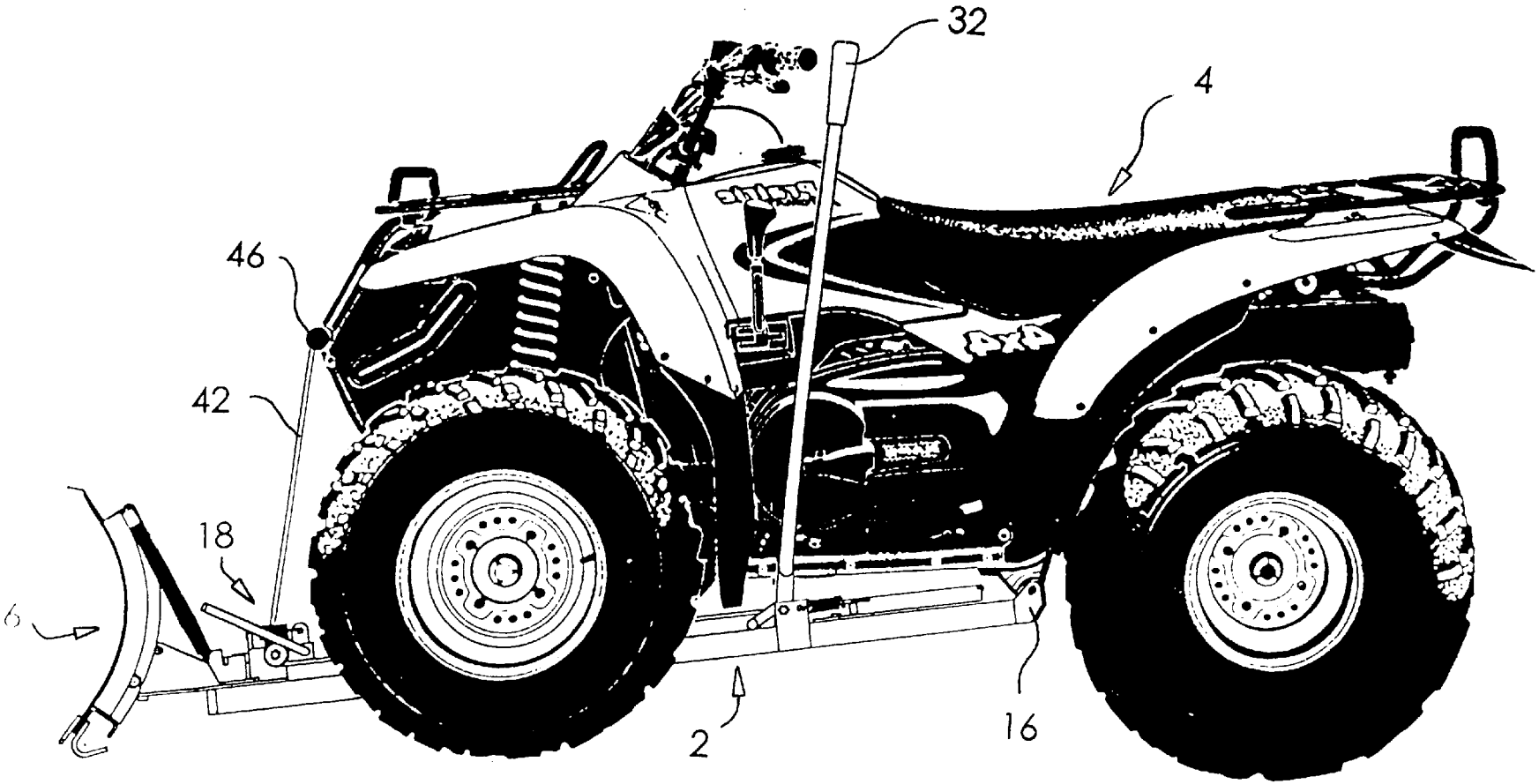
FIG. 1 is a side view showing an ATV incorporating the present invention

In FIG. 1, the lift attachment apparatus of the present invention, generally designated as 2, is shown mounted to an all terrain vehicle (ATV) 4, and a blade assembly 6.

Figure 2:
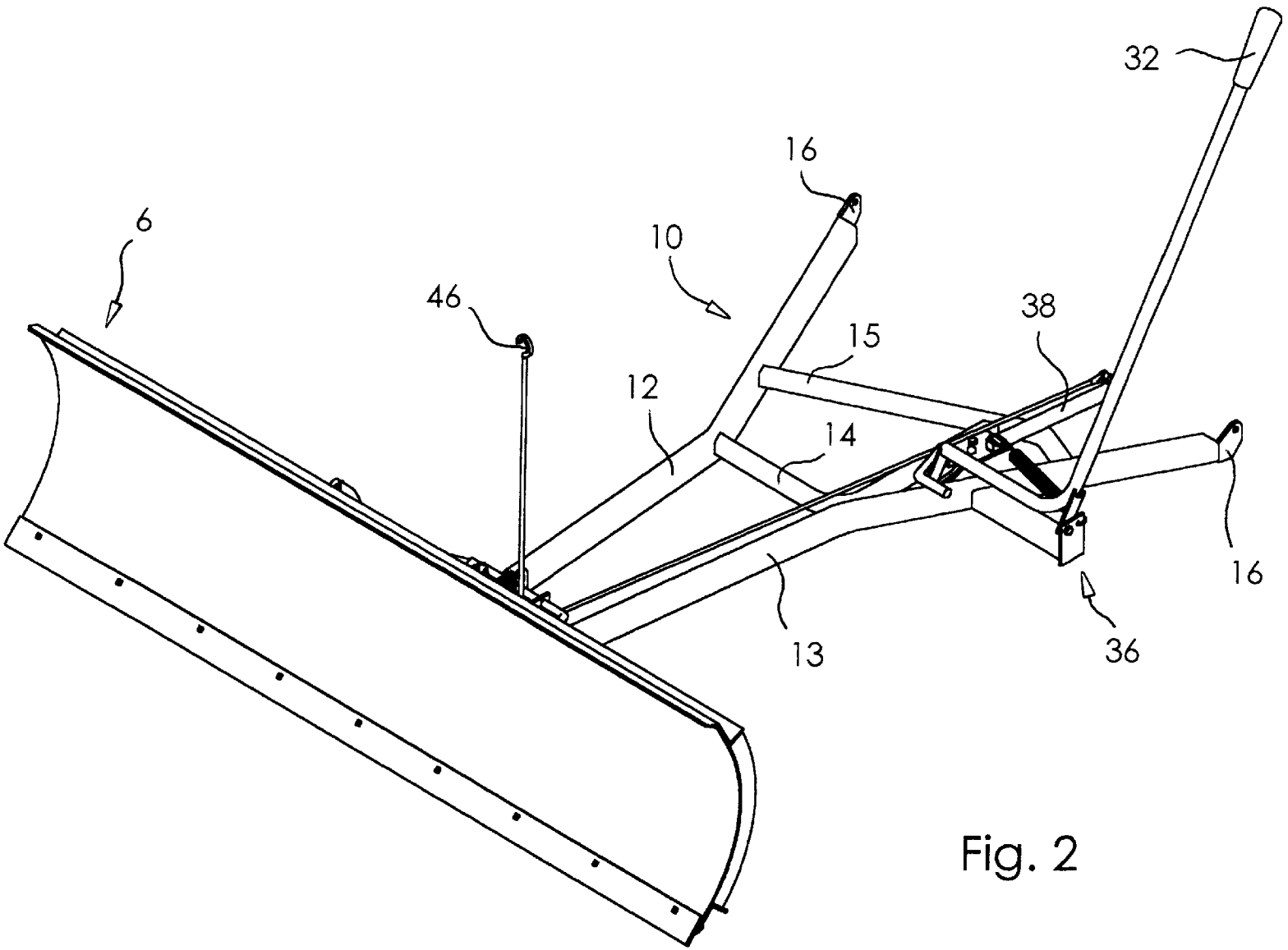
FIG. 2 is a perspective view of the lift attachment apparatus of the present invention, shown in combination with a blade assembly
Figure 3:
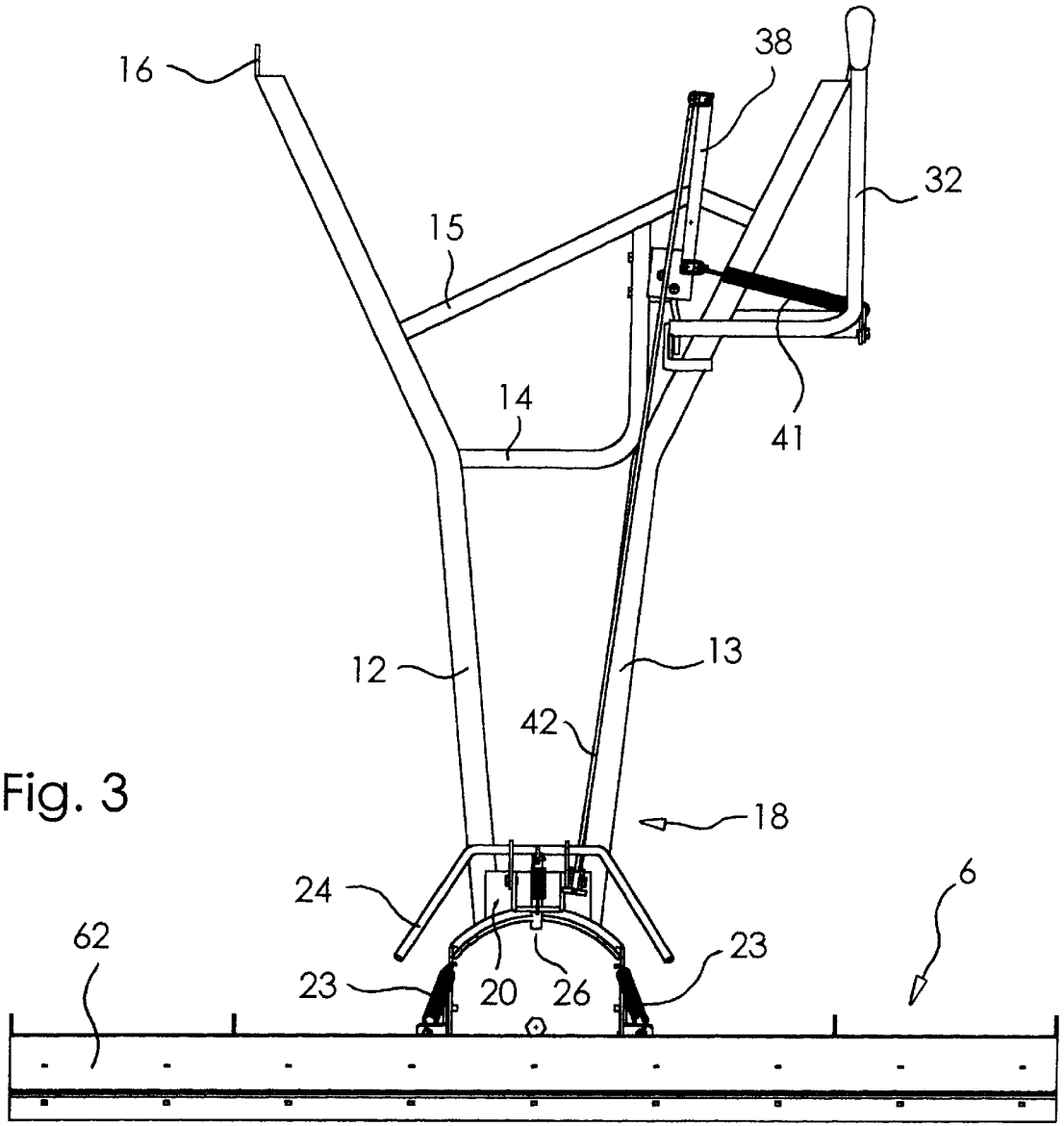
FIG. 3 is a top elevated view of the lift attachment apparatus of the present invention, shown in combination with a blade assembly

Referring to FIGS. 2 and 3, lift attachment apparatus 2 comprises a frame assembly 10, a locking device 18 and over centering lift handle assembly 30.

Frame assembly 10 is of substantially A-shaped design, consisting of diverging arms 12, 13 that are connected by cross members 14, 15 for reinforcement. The posterior end of the frame assembly 10 is defined by attachment means such as lug 16 disposed at one end of each of arms 12, 13. The frame assembly may accordingly be conveniently mounted to the frame of ATV 4, as shown by FIG. 1.

Figure 4:
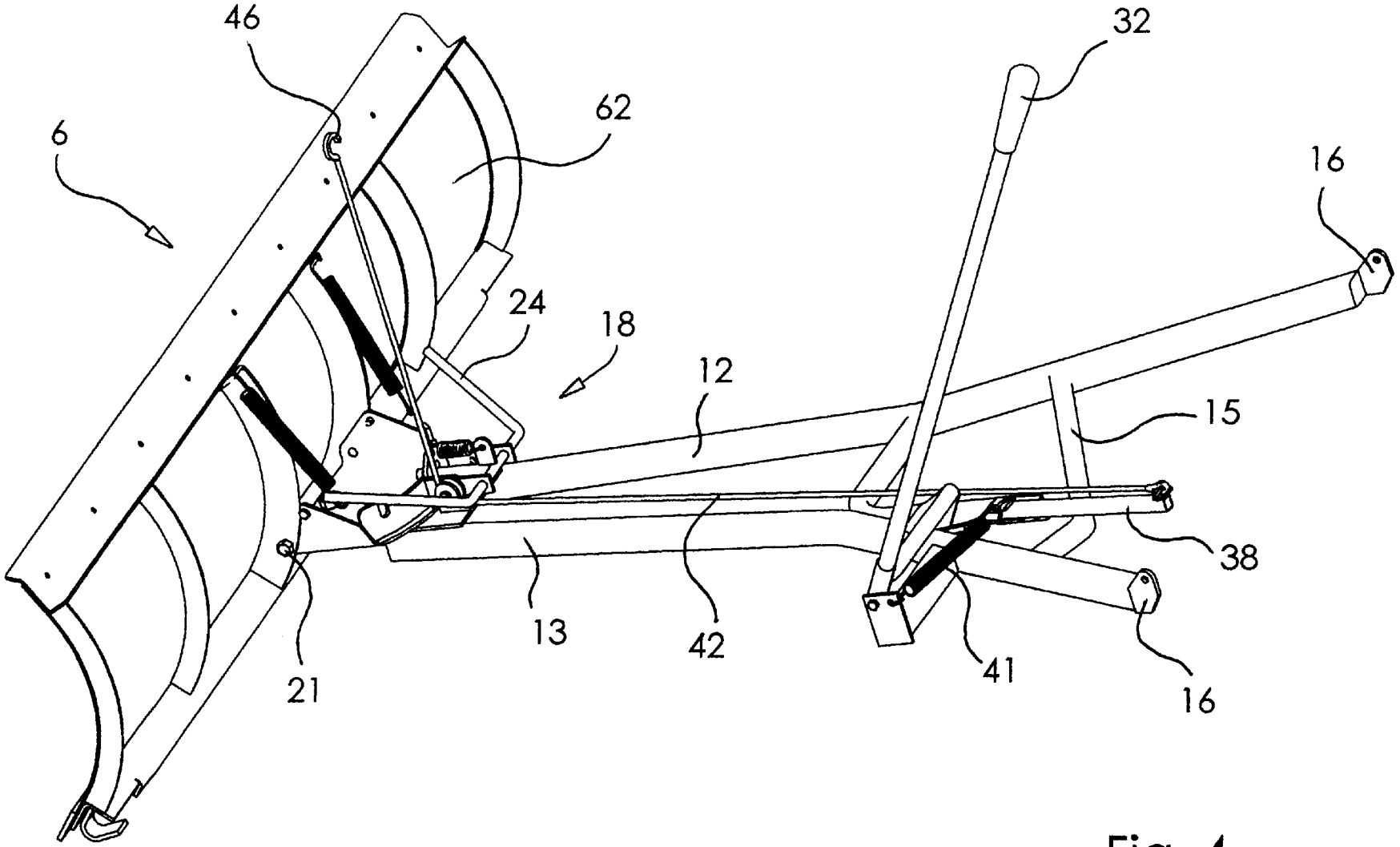
FIG. 4 is a side perspective view of the lift attachment apparatus of the present invention
Figure 4A:
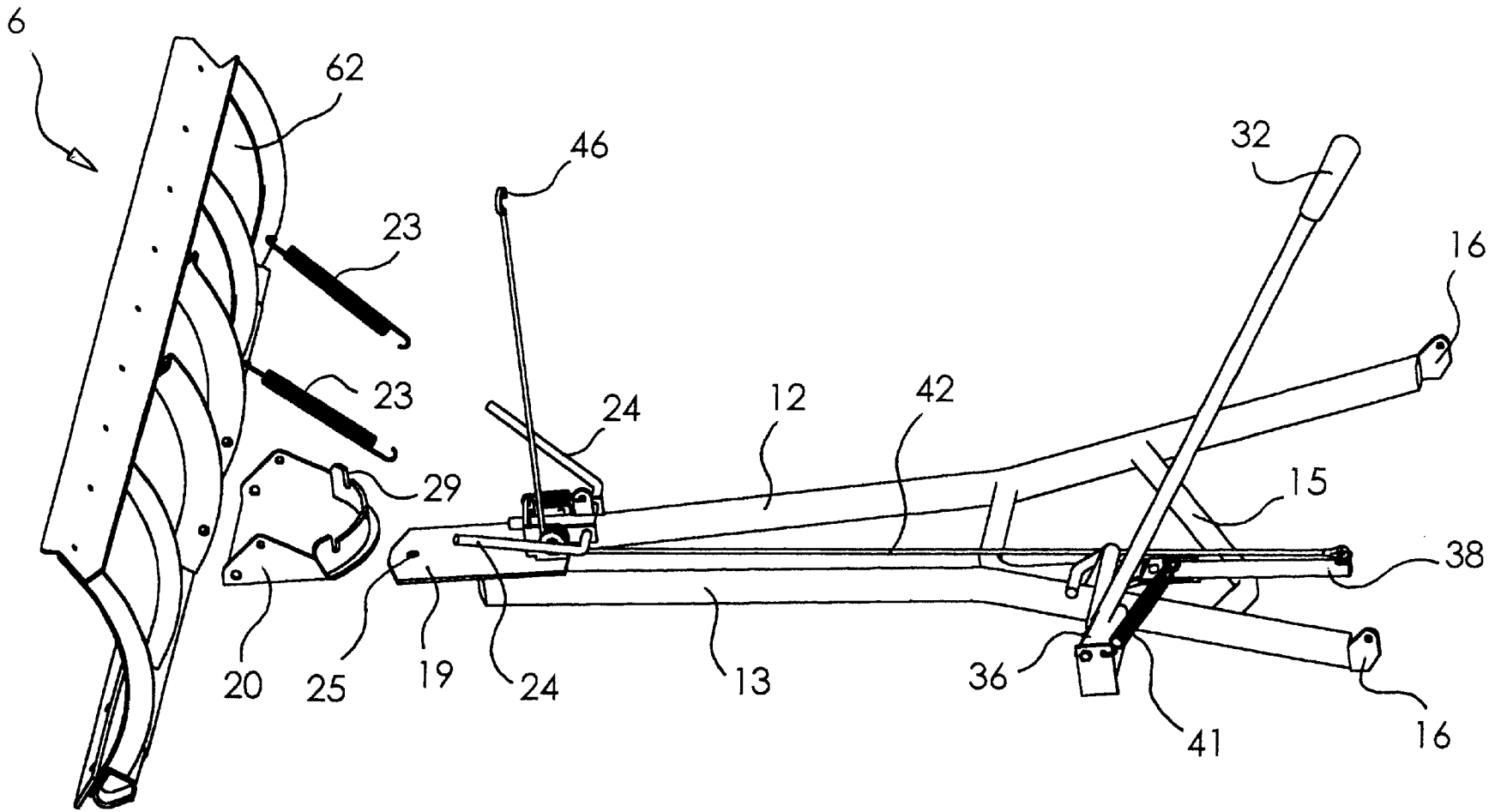
FIG. 4A is a side exploded view of the lift attachment apparatus of the present invention
Figure 5:
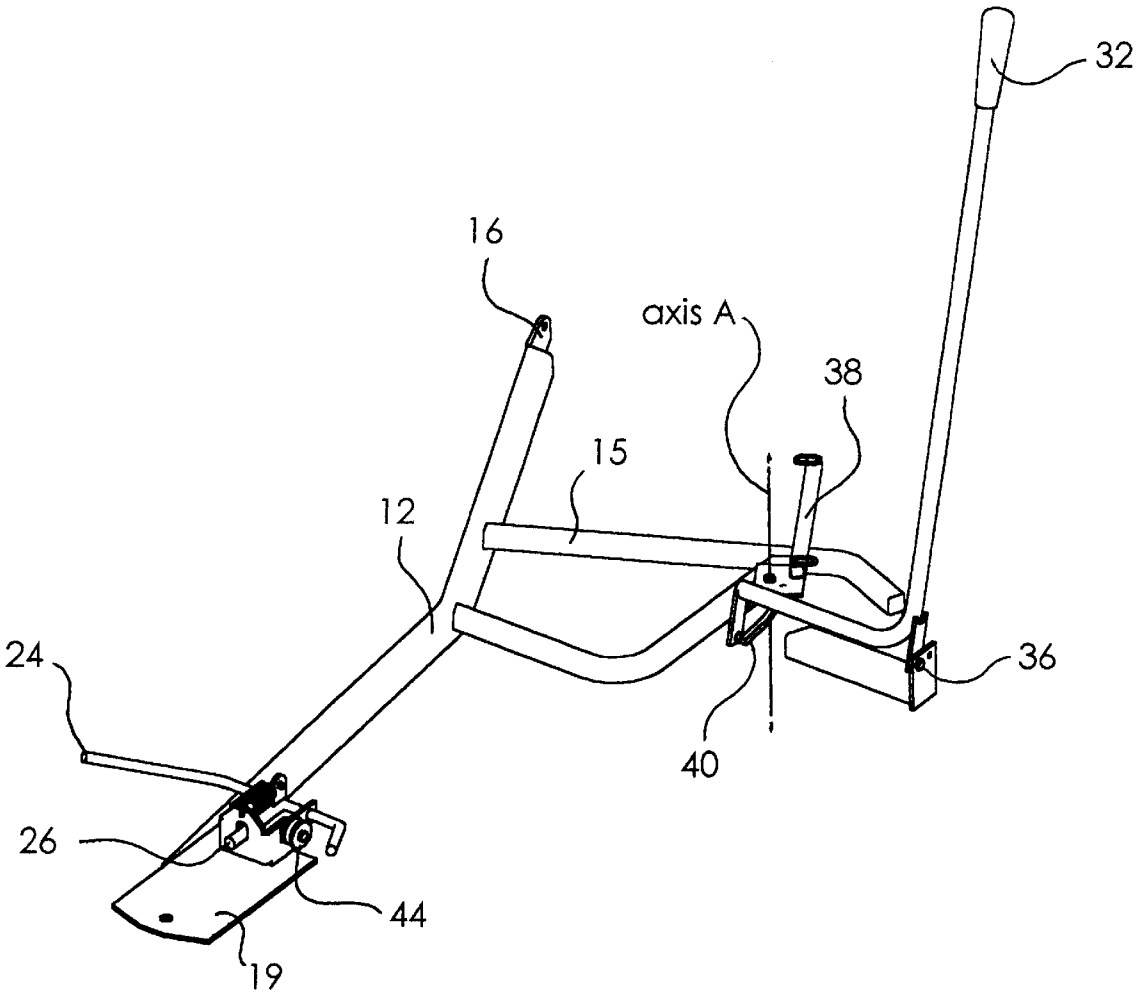
FIG. 5 is a perspective view of the locking means of the lift attachment apparatus
Figure 5A:
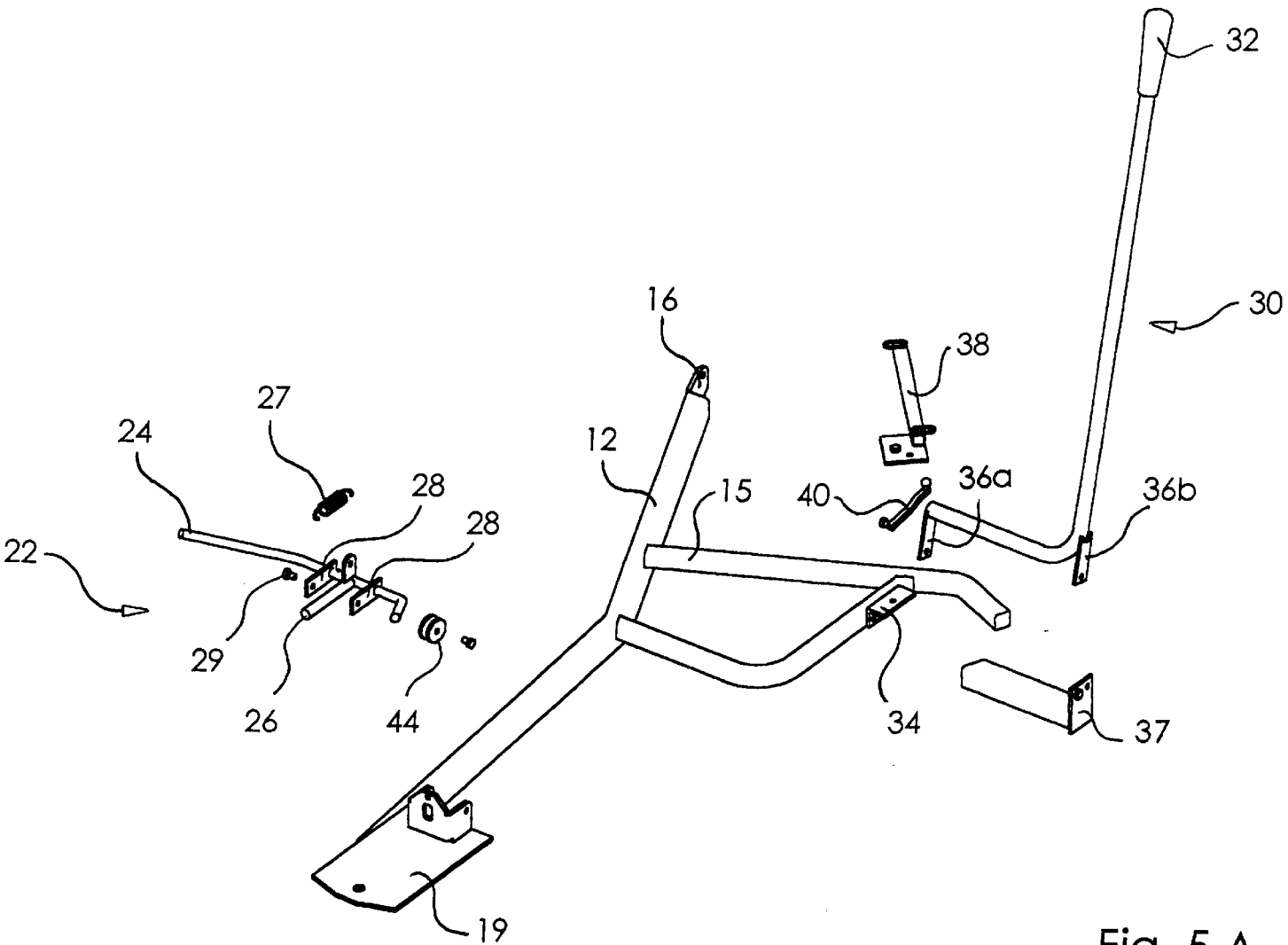
FIG. 5A is an exploded view of the locking means of the lift attachment apparatus

Locking device 18 is mounted to the anterior end of frame assembly 10. As more particularly shown in FIG. 4A, locking device 18 comprises a base plate 19, and frame member 20 which may be secured to blade assembly 6 by means by of a pivot bolt 21 or other similar securement means. Lock pin assembly 22 comprises dual lock handle 24 which is operatively connected to latch lever means 26 by means of lugs 28 and pivot bolts 29, and to lock spring 27.

Frame member 20 is secured to blade assembly 6 by means of bolts or other mechanically equivalent attachment means and is preferably pivotally connected to base plate 19 at attachment point 25. Spring means 23 acts to bias the blade assembly 6 as against the frame member 20.

Over center lift handle assembly means 30 comprises handle member 32 which is pivotally connected to base bracket 34, connecting link 40, lever 36 and over center pivot arm 38. Lock spring 41 is secured to pivot arm 38 and to support member 37. Pivot arm 38 is rotatable along vertical axis A, and may be a first, second, or third class lever. Pivot arm 38 is attached to a lift cable 42. Lift cable 42 runs along the longitudinal axis of the frame assembly 10 and is received by pulley 44 which is operatively connected to locking device 18. The free end of lift cable 42 is fitted with attachment means 46 that enables the cable to be secured to the front bumper, or other suitable attachment point on the ATV.

Figure 6:
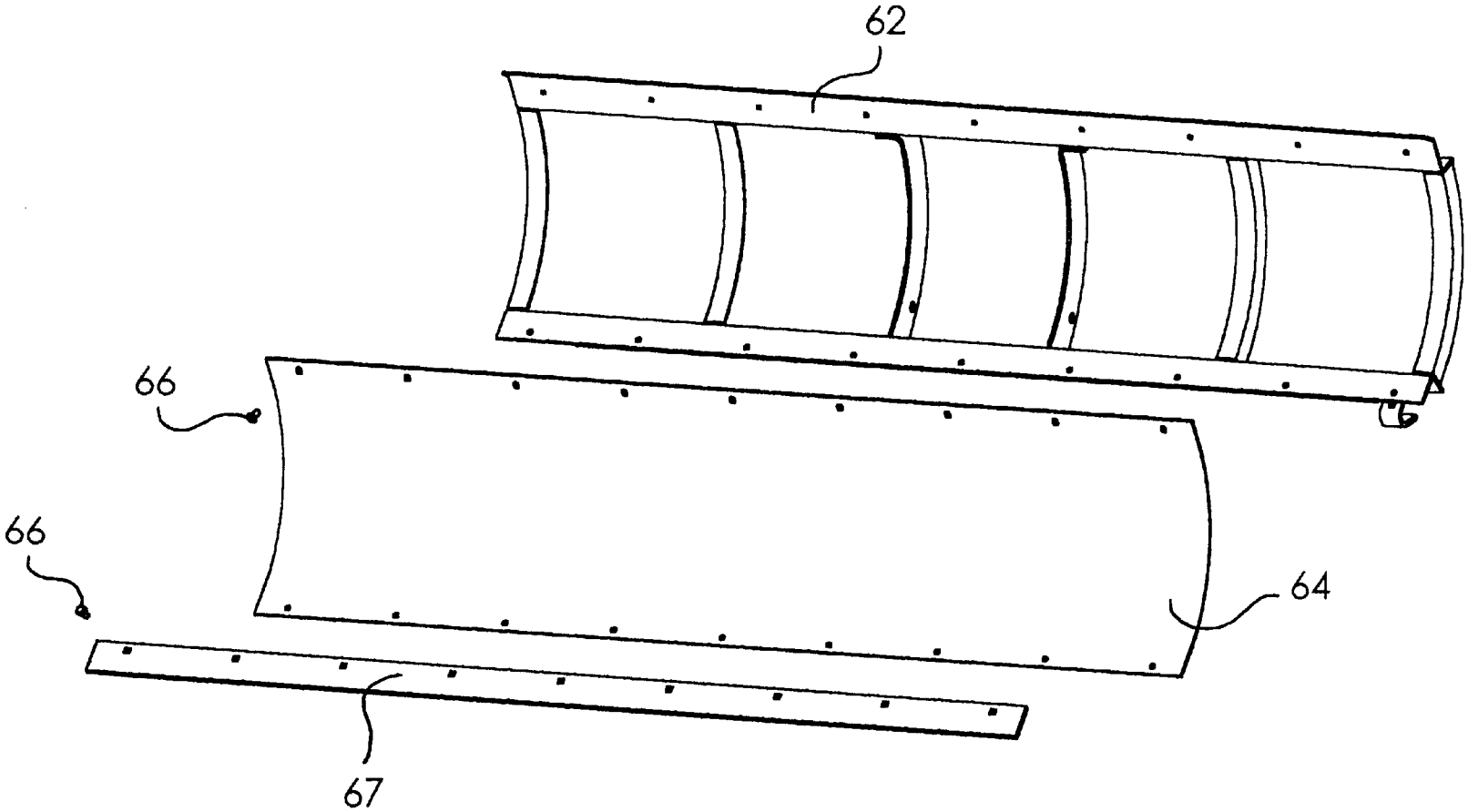
FIG. 6 shows an exploded view of a blade assembly

Referring to FIG. 6, blade assembly 6 includes a blade frame 62 which may optionally be fitted with a replaceable blade liner 64. Blade liner 64 may be detachably secured to blade assembly by means of bolts 66 or similar connection means. Blade frame 62 is rotatably connected to the anterior end of the frame assembly 10, as described above. The detachable liner enables a damaged liner to be inexpensively replaced. It also enables a dealer to stock fewer blade frames, while providing the consumer with a variety of colour options for the liner. Optionally, a blade guard 67 may be incorporated within the blade assembly.

As will be understood by those skilled in the art, the blade assembly 6 may define a single direction, tapered speed blade, or a bidirectional, conventional blade. All conventional blades and blade frames adapted for use for an all terrain vehicle or similar device are within the scope of the present invention.

The orientation of the locking device 18 relative to the frame assembly 20 means that the blade assembly 6 may be attached to the all terrain vehicle, and the relative angle of the blade may be adjusted, from either side of the all terrain vehicle.

The present invention defines an over centering lift system with significant mechanical advantage that enables the operator of the ATV to easily and conveniently raise and lower the blade assembly without undue manipulation. By pulling back on the handle 32, the driver can quickly and easily raise the blade assembly 6. When handle 32 is pulled toward the back of the ATV, the handle lever 36 is pulled toward the front of the ATV which causes the pivot arm 38 to pivot about its axis A, by means of connecting link 40 thereby tightening the lift cable 42 which pulls up on the pulley 44. This motion is translated to frame member 19 and causes blade assembly 6 to move lo vertically, relative to the ground ("up position"). Once the lift cable 42 has passed over the axis A of the pivot arm 38, the weight of the blade assembly 6 would tend to cause the pivot arm 38 to continue pivoting about its axis A thereby urging blade assembly 36 to a downward position. However, a pivot am stop 34 is situated so as to block further movement of the pivot arm 38. This over-centering mechanism holds blade assembly 36 in an up position without the use of pins and extra brackets. The frame assembly 10 and blade assembly 36 remain in the up position by virtue of the over-centering mechanism, described above, until the driver returns the handle 32 to an upright position.

When the handle 32 is in an upright position, the pivot arm 38 is oriented approximately 90 degrees to the longitudinal axis of the ATV, the lift cable 42 is relatively slack and the blade assembly is in a down position, i.e. substantially tangential to the ground surface.

The action of lock spring 41 (attached between the base of the handle 32 and the end of the pivot arm 38 that is attached to the support member 37) reduces the manual effort required to lift the blade assembly and ensures that pivot arm 38 achieves a positive lock in the up or down position, thereby preventing blade assembly 6 from dropping to the ground as the ATV travels over rough terrain.

The angle of the blade assembly 6 relative to the ground surface may be adjusted by pulling up on either side of the dual-handed lock handle 24 to release the latch lever 26, then rotating the frame member 20 about the blade angle pivot attachment point 25 until the blade assembly 6 is at a desired angle relative to the longitudinal axis of the ATV whereupon the latch lever is realigned with a suitable notch 29 on the frame member 20, and then releasing the dual-handed lock handle 24 so that the latch lever 26 matingly engages with the desired notch. Return spring 27 urges the latch lever 26 against the notch 27, and thereby serves to lock the blade assembly 6 into the desired angular orientation, relative the longitudinal axis of the frame assembly 10.

Optionally, the relative mechanical advantage of the over centering lift system may be adjusted by altering the point at which cable 42 is connected to pivot am 38. This may be accomplished by the provision of one or more additional connection points That may take the form of apertures, eyelets or other similar structures that may be used to secure cable 42 to pivot arm 38.

What is claimed is:

1. An apparatus for use in association with an all terrain vehicle, comprising, in combination:

(a) a frame assembly consisting of first arm member and a second arm member having respective anterior and posterior ends, said arm members being oriented in substantially diverging configuration relative to one another, at least one cross member bridging said first and second members wherein said first member, said second member and said cross member define a frame having a substantially A-shaped configuration, said frame having a front end and a back end, wherein said frame is adapted to be attached to the vehicle body of said all terrain vehicle such that said frame is oriented substantially parallel to the ground, said front end extending forwardly between the front wheels of said all terrain vehicle and said back end extends rearwardly and upwardly such that the posterior ends of said first member and said second member are respectively oriented substantially adjacent said vehicle body;

(b) mounting means for securing said frame to said vehicle body, wherein said mounting means comprises means for attaching the posterior ends of said first member and said second member to said vehicle body;

(c) a blade assembly adapted for mounting to the front end of said frame assembly;

(d) angle adjustment means for adjusting the angle of said blade assembly relative to the longitudinal axis of said all terrain vehicle, comprising means for pivotally connecting said blade assembly to said front end of said frame to enable the orientation of said blade assembly relative to the longitudinal axis of said all terrain vehicle to be angularly adjusted, locking means to releasably secure said blade assembly in a desired angular orientation relative to said longitudinal axis of said all terrain vehicle, and a dual-handled lever for operating said locking means from either side of said all terrain vehicle; and (e) an over center lift means to facilitate the raising and lowering of said blade assembly in a substantially vertical plane relative to the ground and for enabling the operative locking and unlocking of said blade assembly in a desired vertical position relative to the ground, said over center lift means comprising: a handle for actuating said over center lift means; cable and pulley means operatively connected to said handle, said cable and pulley means comprising a pulley attached to the front end of said frame assembly, a lift cable having a first end and a second end, wherein said lift cable runs through and operatively engages said pulley, said first end of said lift cable being releasably attached to the frame of said all terrain vehicle; lever means operatively assembled to translate the force from actuation of said handle to said cable and pulley means, said lever means comprising a vertical axis pivot arm having a first end connected to said handle and a second end connected to said second end of said lift cable and a pivot arm stop adapted to prevent said pivot arm from moving beyond a point wherein said lift cable has passed over the vertical axis of said pivot arm.

2. An apparatus according to claim 1 wherein said blade assembly comprises a blade frame and a detachable blade liner.

3. An apparatus according to claim 1 or 2 wherein said locking means of said angle adjustment means comprises: a latch pin rotatable in a vertical direction on a latch pivot point and actuated by said dual-handled lever; a plurality of notches at spaced apart intervals on said connecting means and adapted to matingly receive said latch pin; and spring means for biasing said latch pin toward said notches.

* * * * *